US006824068B2

(12) United States Patent
Minowa et al.

(10) Patent No.: US 6,824,068 B2
(45) Date of Patent: Nov. 30, 2004

(54) EXPANSION VALVE

(75) Inventors: Masakatsu Minowa, Tokyo (JP); Kazuhiko Watanabe, Tokyo (JP); Masamichi Yano, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 10/366,443

(22) Filed: Feb. 14, 2003

(65) Prior Publication Data

US 2003/0172668 A1 Sep. 18, 2003

(30) Foreign Application Priority Data

Mar. 15, 2002 (JP) ..... 2002/072852

(51) Int. Cl.[7] ..... G05D 27/00

(52) U.S. Cl. ..... 236/92 B; 62/222; 62/296; 251/367; 137/375

(58) Field of Search ..... 62/222, 296; 236/92 B; 251/367, 366; 137/375

(56) References Cited

U.S. PATENT DOCUMENTS 3,915,185 A * 10/1975 Sanner ..... 137/78.3
3,917,218 A * 11/1975 Marocco ..... 251/30.03
4,342,421 A * 8/1982 Widdowson ..... 236/92 B
5,555,739 A * 9/1996 Kujirai et al. ..... 62/244
RE37,423 E * 10/2001 Glennon et al. ..... 236/92 B
6,354,509 B1 * 3/2002 Fukuda et al. ..... 236/92 B
2002/0023462 A1 2/2002 Kato et al.

FOREIGN PATENT DOCUMENTS

EP 0539944 A2 * 5/1993
JP 2000-203251 A1 7/2000
JP 02000310352 A * 11/2000
JP 2001-150941 A1 6/2001
JP 2001-199230 A1 7/2001
JP 2002-243312 A1 8/2001
JP 2002-029251 A1 1/2002

* cited by examiner

*Primary Examiner*—William E. Tapolcai
*Assistant Examiner*—Mohammad M. Ali
(74) *Attorney, Agent, or Firm*—Rader, Fishman & Grauer PLLC

(57) ABSTRACT

Two case members of the same shape are attached to the body of an expansion valve and a temperature sensing drive element through sound insulating members. Each of the two case members is formed having upper retaining and retainable portions at its upper part and lower retaining and retainable portions at its lower part. The upper retaining portion, upper retainable portion, lower retaining portion, and lower retainable portion of one of the case members are in engagement with the upper retainable portion, upper retaining portion, lower retainable portion, and lower retaining portion, respectively, of the other case member.

17 Claims, 11 Drawing Sheets

FIG. 10 PRIOR ART
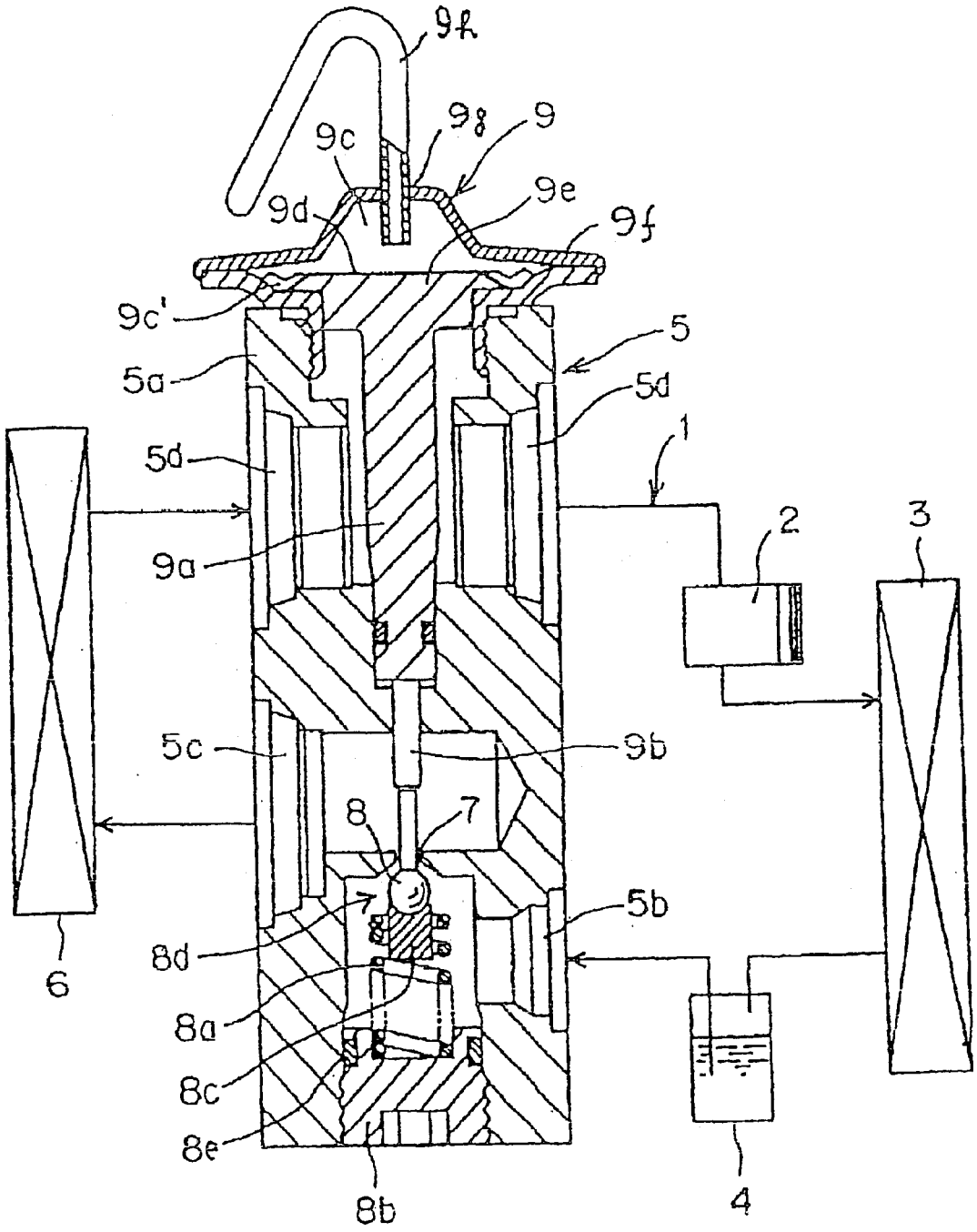

FIG. 11 PRIOR ART
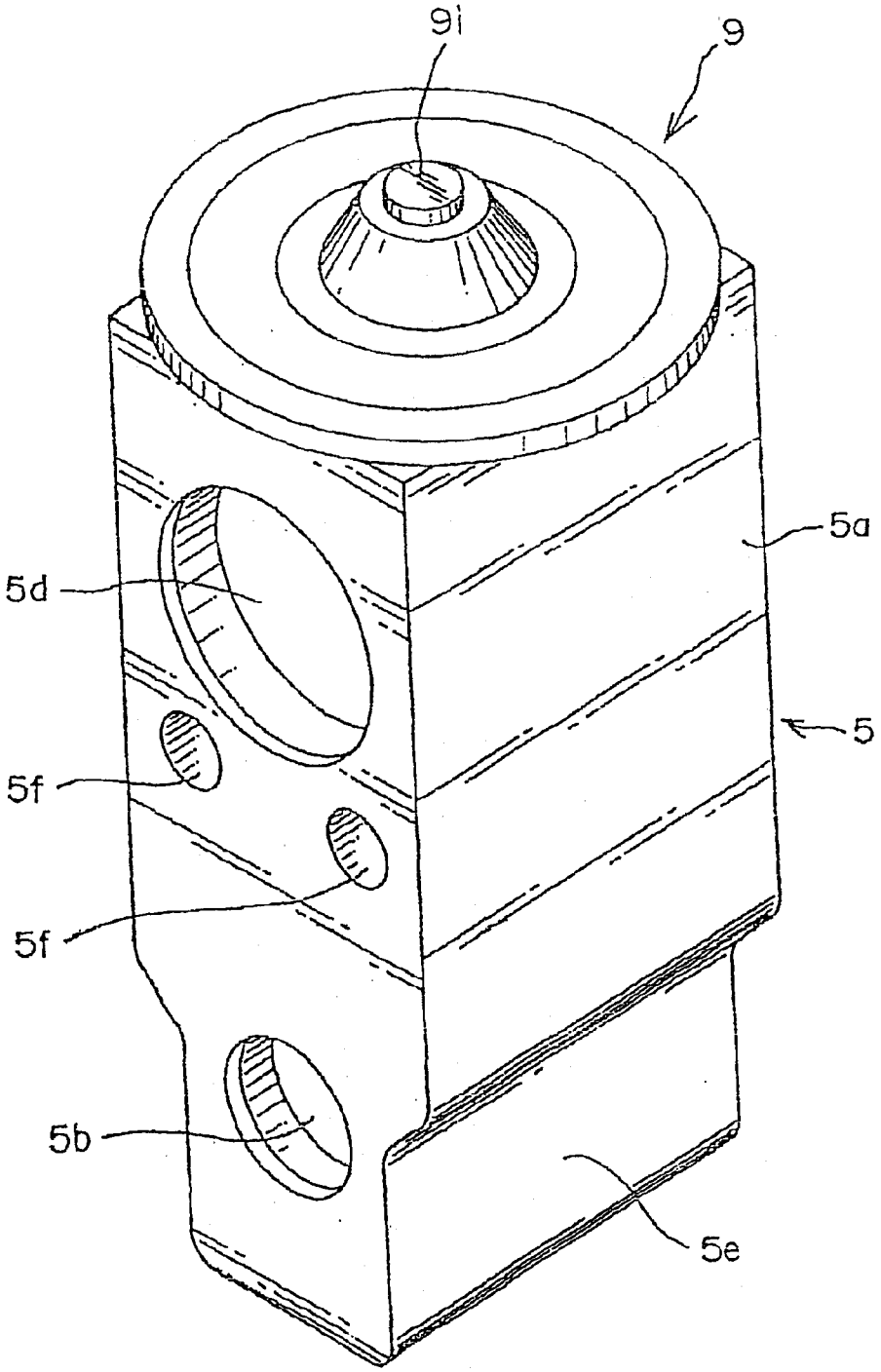

EXPANSION VALVE

BACKGROUND OF THE INVENTION

1. Field of the Invention

The present invention relates to an expansion valve that constitutes a refrigerating cycle, and more specifically, to an expansion valve capable of excluding noise produced therein.

2. Description of the Prior Art

There are various types of expansion valves. In widely used expansion valves, a valving element is opposed from the upper-stream side to an orifice that is formed by constricting the middle of a high-pressure refrigerant passage through which a high-pressure refrigerant is fed into an evaporator. The valving element is opened and closed according to the temperature and pressure of a low-pressure refrigerant that is delivered from the evaporator.

An example of the expansion valves of this type is used in a refrigerating cycle of an automotive air conditioner or the like. As shown in FIG. 10, the refrigerating cycle comprises a refrigerant compressor 2 that is driven by means of an engine, a condenser 3 connected to the discharge side of the refrigerant compressor 2, and a receiver 4 connected to the condenser 3. The refrigerating cycle further comprises an expansion valve 5, which adiabatically expands a liquid refrigerant from the receiver 4 into a vapor-liquid refrigerant, and an evaporator 6 connected to the valve 5.

A valve body 5*a* of the expansion valve 5 is formed having a high-pressure-side passage 5*b* into which the liquid refrigerant flows and a low-pressure-side passage 5*c* through which the vapor-liquid refrigerant flows out. The high- and low-pressure-side passages 5*b* and 5*c* communicate with each other by means of an orifice 7. A valve chamber 8*d* is provided with a valving element 8 for adjusting the flow rate of the refrigerant that passes through the orifice 7.

The expansion valve body 5*a* is penetrated by a low-pressure refrigerant passage 5*d*. A plunger 9*a* is slidably located in the passage 5*d*. The plunger 9*a* is driven by means of a temperature sensing drive element 9 that is fixed on the top of the valve body 5*a*. The drive element 9 is divided into two parts, an upper gastight chamber 9*c* and a lower gastight chamber 9*c*', by a diaphragm 9*d*. A disc portion 9*e* on the upper end of the plunger 9*a* abuts against the diaphragm 9*d*. A tube fixing hole 9*g* is formed in the central portion of a top lid 9*f* of the temperature sensing drive element 9. A capillary tube 9*h* is attached to the hole 9*g*.

At the lower part of the expansion valve body 5*a*, a compression coil spring 8*a* is located in the valve chamber 8*d*. The spring 8*a* causes a support member 8*c* to press the valving element 8 in the valve-closing direction. The valve chamber 8*d* is defined by an adjust screw 8*b* that mates with the valve body 5*a* and is kept gastight by means of an O-ring 8*e*. An operating rod 9*b* abuts against the lower end of the plunger 9*a*. The rod 9*b* causes the valving element 8 to move in the valve-opening direction as the plunger 9*a* slides.

The plunger 9*a* in the temperature sensing drive element 9 transmits temperature in the low-pressure refrigerant passage 5*d* to the upper gastight chamber 9*c*. Pressure in the chamber 9*c* changes according to this temperature. If the temperature is high, for example, the pressure in the chamber 9*c* increases, so that the diaphragm 9*d* presses down the plunger 9*a*. Thereupon, the valving element 8 moves in the valve-opening direction to increase the flow rate of the refrigerant that passes through the orifice 7, thereby lowering the temperature of the evaporator 6.

If the temperature is low, on the other hand, the pressure in the upper gastight chamber 9*c* lowers, so that the force of the diaphragm 9*d* to press down the plunger 9*a* is reduced, and the valving element 8 is moved in the valve-closing direction by means of the compression coil spring 8*a* that urges the element 8 in the same direction. Thereupon, the flow rate of the refrigerant that passes through the orifice 7 lowers, and the temperature of the evaporator 6 rises.

Thus, the expansion valve 5 moves the valving element 8 to change the opening area of the orifice 7 according to the temperature change in the low-pressure refrigerant passage 5*d*, thereby adjusting the temperature of the evaporator 6. In the expansion valve 5 of this type, the opening of the orifice 7, which adiabatically expands the liquid refrigerant into the vapor-liquid refrigerant, is set in a manner such that the spring load of the variable-load compression coil spring 8*a*, which presses the valving element 8 in the valve-closing direction, is adjusted by means of the adjust screw 8*b*.

In the expansion valve 5 shown in FIG. 10, the capillary tube 9*h* is attached to the tube fixing hole 9*g* of the temperature sensing drive element 9. FIG. 11 shows another example of the expansion valve 5. In this example, a sealing plug 9*i* is attached in place of the tube 9*h* to the hole 9*g*. The expansion valve body 5*a* is in the form of a column having a square cross section. Thin-walled portions 5*e* are formed individually on the opposite sides of the bottom portion of the body 5*a*, and bolt holes 5*f* are bored near the low-pressure refrigerant passage 5*d*.

The expansion valve 5 shown in FIG. 10 is a temperature-type expansion valve that detects the outlet temperature of the evaporator 6 (temperature of the low-pressure refrigerant passage 5*d*) and transmits it to the temperature sensing drive element 9 of the valve 5. If the expansion valve of this type is used in a refrigeration system of an air conditioner of an automobile, for example, in general, the automobile is left for a while under relatively high-load conditions related to the outside and inside air temperatures. If the refrigerating cycle (air-cooling operation) is then started, the liquid refrigerant is fed into the evaporator at a high rate, since the opening of the expansion valve is wide. Possibly, therefore, noise may be produced when the refrigerant passes through the expansion valve.

In some cases, moreover, the high-pressure refrigerant that is fed into the expansion valve may be subjected to pressure fluctuation on the upper-stream side in the refrigerating cycle. This pressure fluctuation is transmitted to the valve by the medium of the high-pressure refrigerant. Thereupon, in the expansion valve shown in FIG. 10, the refrigerant may possibly produce noise as it expands. When the pressure fluctuation of the refrigerant on the upper-stream side is transmitted to the valving element, the operation of the valving element may become unstable. In this case, vibration of the valving element may possibly produce noise.

Accordingly, a sound insulating case has been proposed as a measure to tackle the above problems of the prior art (Japanese Patent Application Laid-open No. 2002-29251). It is attached to the outside of an expansion valve lest noise leak out. Since this sound insulating case has a complicated shape, however, its manufacturing cost is high, and its attachment to the expansion valve is very troublesome.

OBJECT AND SUMMARY OF THE INVENTION

The object of the present invention is to provide an expansion valve, which can be easily fitted with sound insulating members having simple construction and has excellent sound insulating and vibration-proof effects.

According to a first aspect of the invention, there is provided an expansion valve comprising two case members of the same shape attached to an expansion valve body through sound insulating members.

Each case member has retaining portions and retainable portions arranged at the upper and lower parts thereof, the retaining portion of one case member being capable of engaging the retainable portion of the other case member, and the retainable portion of the one case member being capable of engaging the retaining portion of the other case member.

The outer surface of each case member is flat.

According to a second aspect of the invention, there is provided an expansion valve comprising two sound insulating members of the same shape attached to an expansion valve body so as to cover the same.

Each sound insulating member has retaining portions and retainable portions arranged at the upper and lower parts thereof, the retaining portion of one sound insulating member being capable of engaging the retainable portion of the other sound insulating member, and the retainable portion of the one sound insulating member being capable of engaging the retaining portion of the other sound insulating member.

The outer surface of each sound insulating member is flat.

According to a third aspect of the invention, there is provided an expansion valve comprising an expansion valve body having therein a high-pressure-side passage, low-pressure-side passage, and orifice internally connecting the passages, a valving element opposed to the orifice, and a temperature sensing drive element having a diaphragm for driving the valving element by means of an operating rod and being located outside the expansion valve body. The expansion valve further comprises a case member attached to the expansion valve body and the temperature sensing drive element so as to extend along the whole contours thereof except outlets and inlets of the passages in the expansion valve body. The case member includes two members of the same shape in engagement with each other.

The case member is attached to the entire temperature sensing drive element except a part thereof.

The case member is mounted through a sound insulating member.

One of the two members constituting the case member is formed having a retaining portion, and the other member is formed having a retainable portion in a position corresponding to the retaining portion, the case member being attached to the expansion valve body and the temperature sensing drive element with the retaining portion and the retainable portion in engagement with each other.

The retaining portion and the retainable portion are formed inside the case member.

Each of the two members constituting the case member is formed having a retaining portion and a retainable portion, the case member being attached to the expansion valve body and the temperature sensing drive element in a manner such that the retaining portion of one of the members is in engagement with the retainable portion of the other member and that the retainable portion of the one member is in engagement with the retaining portion of the other member.

The retaining portion and the retainable portion are arranged side by side on each member.

According to the invention, moreover, there is provided a sound insulating case of an expansion valve, comprising two sound insulating members of the same shape and two case members of the same shape for holding the sound insulating members.

Constructed in this manner, the expansion valve according to the present invention has the following effects.

Since the two case members of the same shape are attached to the expansion valve body with the sound insulating members between them, sound insulating and vibration-proof effects can be obtained, and besides, it is necessary only that components of the same shape be prepared as the case members. Thus, the manufacturing cost can be lowered, and handling the valve can be facilitated.

Since the two sound insulating members of the same shape are attached to the expansion valve body, sound insulating and vibration-proof effects can be obtained, and besides, the construction can be simplified, and handling can be made easier.

The retaining and retainable portions are formed side by side on the respective upper and lower parts of the case members. Thus, the two members of the same shape can be easily mounted or removed at a stroke in a manner such that the retaining and retainable portions are caused to engage one another when the members are attached to the expansion valve body.

Since the outer surface of each case member or sound insulating member is flat, handling properties, such as the ease of attachment of the expansion valve as a whole, are improved.

Since the two case members of the same shape are attached to the expansion valve body, sound insulating and vibration-proof effects can be obtained, and besides, it is necessary only that components of the same shape be prepared as the case members. Thus, the manufacturing cost can be lowered, handling the valve can be facilitated, and the construction can be simplified. Further, the retaining and retainable portions are formed side by side on the respective upper and lower parts of the case members. Thus, the two members of the same shape can be easily mounted or removed at a stroke in a manner such that the retaining and retainable portions are caused to engage one another when the members are attached to the expansion valve body.

Since the sound insulating case of the expansion valve is composed of the two sound insulating members of the same shape and the two case members of the same shape for holding the sound insulating members, the number of indispensable components can be reduced.

BRIEF DESCRIPTION OF THE DRAWINGS

FIG. 10 is a longitudinal sectional view of a prior art expansion valve located in a refrigerating cycle; and FIG. 11 is a perspective view showing an outline of a prior art expansion valve different from the expansion valve of FIG. 10.

DETAILED DESCRIPTION OF THE PREFERRED EMBODIMENTS

Figure 1:
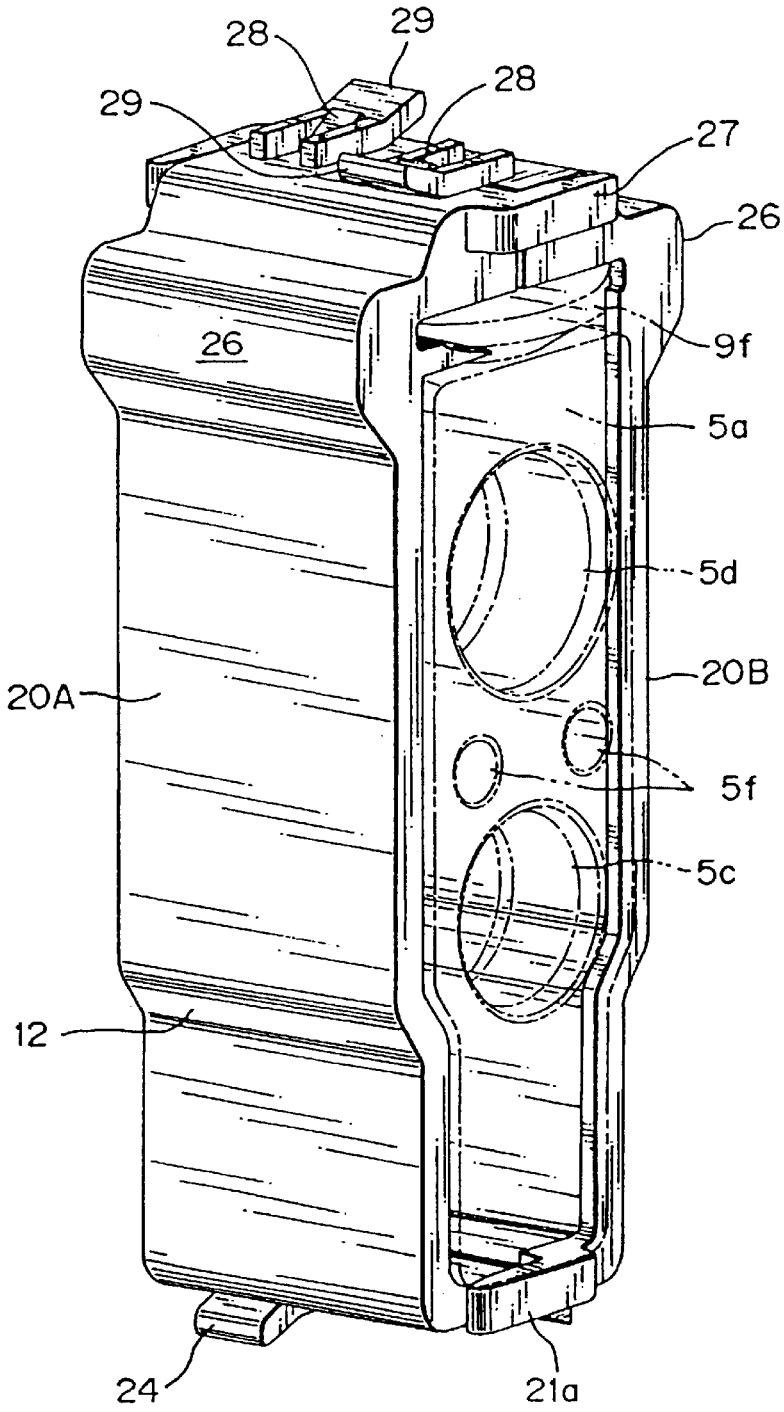
FIG. 1 is a perspective view showing an outline of an expansion valve according to a first embodiment of the invention.

Preferred embodiments of the present invention will now be described with reference to the accompanying drawings. The following embodiments are applied to a sound insulating case (sound insulating member and case member) that is applicable to an expansion valve 5 having the external appearance shown in FIG. 11.

A first embodiment of the invention will now be described with reference to FIGS. 1 to 3. The sound insulating case of the expansion valve 5 according to the present embodiment is composed of two sound insulating members 10A and 10B of the same shape and two case members 20A and 20B of the same shape that hold the members 10A and 10B, respectively.

The sound insulating members 10A and 10B of the present embodiment are attached individually to the left- and right-hand sides of the expansion valve 5 (two side faces perpendicular to a side face in which a low-pressure-side passage 5*c* and a low-pressure refrigerant passage 5*d* opens). The inside of the sound insulating member 10A (in contact with the valve 5) is formed having a fixed width such that it extends along the external shape of the valve 5. The member 10A is composed of a bottom receiving portion 11 in engagement with a half of the base of the expansion valve 5, a bent portion 12 adjacent thereto, and a top cover portion 15 that engages the top portion (temperature sensing drive element 9) of the valve 5. Thus, the sound insulating member 10A is substantially in the form of a continuous plate as a whole. The end face of the bottom receiving portion 11 constitutes a bottom abutting surface 11*a*.

The sound insulating members 10A and 10B are formed of synthetic resin or rubber that has high sound insulating and deadening effects and can be elastically deformed to some degree. Preferably, the members 10A and 10B have a size such that they are compressed horizontally and vertically by a margin of, for example, about 1 mm when they are fitted in the case members 20A and 20B, respectively. However, the sound insulating members 10A and 10B need not always be elastically deformable.

The top cover portion 15 is formed having a top lid receiving portion 13 corresponding to the base of the temperature sensing drive element 9 of the expansion valve 5 and a lid fitting groove 14 in which the top lid 9*f* is fitted. Further, a top recess 17 is formed in the lower surface of the top cover portion 15. A top abutting surface 15*a* is formed on the end face of the top cover portion 15. A rear overhang portion 16 is formed on the back surface of the top cover portion 15.

After the sound insulating members 10A and 10B are opposed to each other with the expansion valve between them, their respective bottom abutting surfaces 11*a* are caused to engage each other, and their respective top abutting surfaces 15*a* are also caused to engage each other. By doing this, the expansion valve 5 can be covered by means of the two sound insulating members 10A and 10B. As this is done, the top lid 9*f* is fitted in the respective lid fitting grooves 14 of the members 10A and 10B.

The case members 20A and 20B are located outside the sound insulating members 10A and 10B, respectively, and hold them. Since the case members 20A and 20B have the same shape, as mentioned before, only the one case member 20A will be described below.

Figure 3:
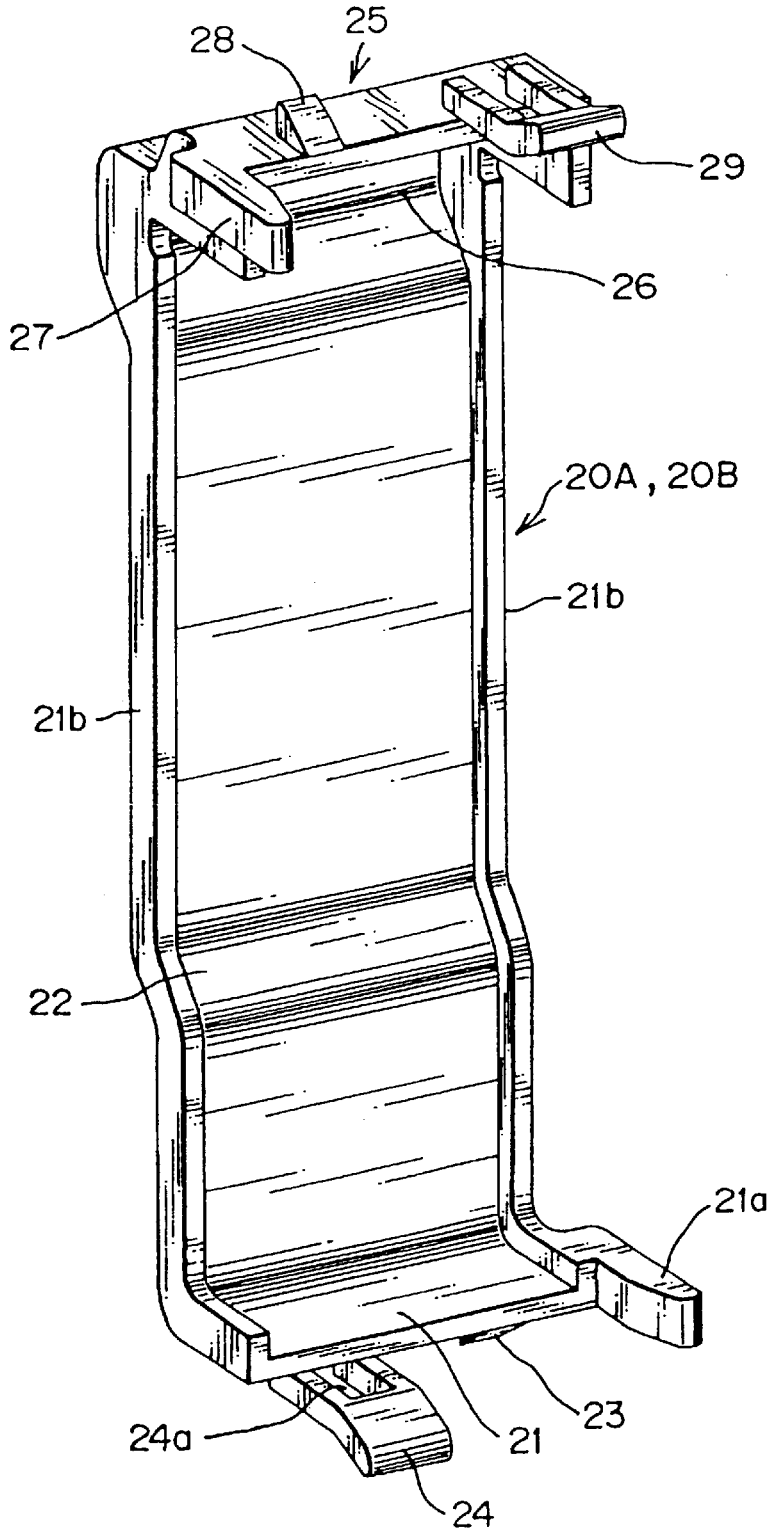
FIG. 3 is a perspective view of a case member that constitutes the expansion valve of the first embodiment.

As shown in FIG. 3, the inside of the case member 20A has a fixed width and substantially the same shape as the external shape of the sound insulating member 10A. A bottom receiving portion 21 is formed at the bottom of the case member 20A, and a bent portion 22 is formed over the receiving portion 21. Further, a rear overhang portion 26 is formed over the bent portion 22, and a top cover portion 25 is formed on the top of the rear overhang portion 26. Thus, the case member 20A is substantially in the form of a continuous plate as a whole.

An lower side face engaging portion 21*a* extends forward from one side portion of the bottom receiving portion 21 of the case member 20A. Further, a bottom retaining portion 23 and a bottom retainable portion 24 are projectingly arranged side by side on the lower surface of the bottom receiving portion 21. The bottom retaining portion 23 is in the form of a projection having a triangular profile. The bottom retainable portion 24 is formed of an elastic material and has an opening 24*a* in its center in which the bottom retaining portion 23 of the opponent case member 20B can be fitted.

An upper side face engaging portion 27 having the same shape with the lower side face engaging portion 21*a* extends forward from one side portion of the top cover portion 25 of the case member 20A. Further, a top retaining portion 28 having the same shape with the bottom retaining portion 23 and a top retainable portion 29 having the same shape with the bottom retainable portion 24 are projectingly arranged side by side on the upper surface of the top cover portion 25.

Furthermore, edge portions 21*b* having a uniform height from top to bottom are formed individually on the left- and right-hand side edge portions of the case member 20A.

Figure 2:
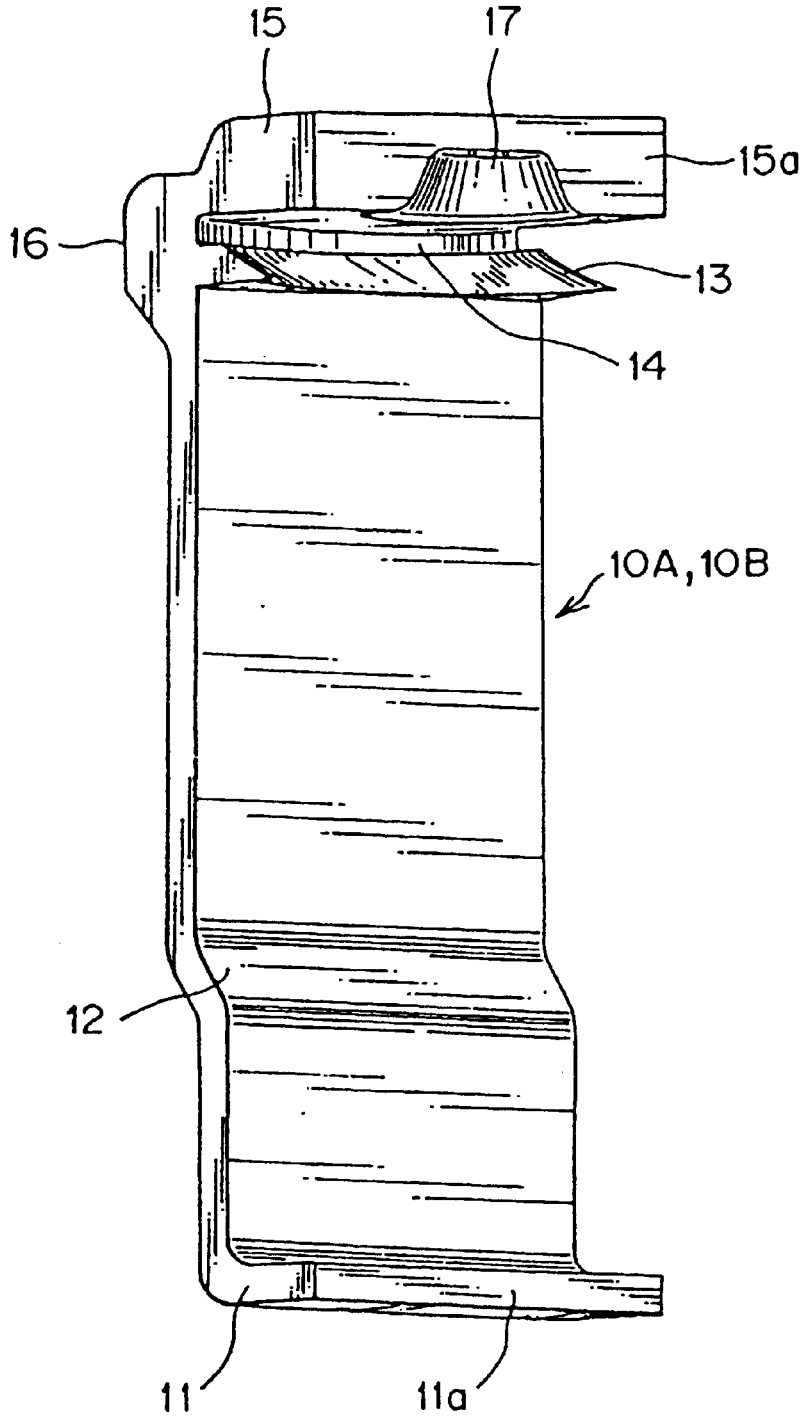
FIG. 2 is a perspective view of a sound insulating member that constitutes the expansion valve of the first embodiment.

In arranging the case members 20A and 20B individually on the opposite side portions of the expansion valve body 5*a*, as shown in FIG. 1, the sound insulating member 10A is first fitted on that side of the one case member 20A which faces the valve body 5*a*. Likewise, the sound insulating member 10B is fitted on that side of the other case member 20B which faces the valve body 5*a*. Thereafter, these members are located individually on the opposite sides, left and right, of the valve body 5*a*. After the members are positioned by means of the lower and upper side face engaging portions 21*a* and 27, the bottom retainable portion 24 of the case member 20B is anchored to the bottom retaining portion 23 of the case member 20A, while the bottom retainable portion 24 of the case member 20A is anchored to the bottom retaining portion 23 of the case member 20B.

Further, the respective tops of the case members 20A and 20B are positioned by means of their respective upper side face engaging portions 27. Then, the top retainable portion 29 of the case member 20B is anchored to the top retaining portion 28 of the case member 20A, while the top retainable portion 29 of the case member 20A is anchored to the top retaining portion 28 of the case member 20B. Thus, the two case members 20A and 20B can be coupled also at their top portions by being only butted against each other.

In this state, the two sound insulating members 10A and 10B can be securely held on the left and right, respectively, of the expansion valve body 5*a*, so that noise and vibration produced in the expansion valve body 5*a* can be attenuated, and heat insulating effect can be produced.

Disengaging the case members 20A and 20B, like their engagement, is very easy.

The bottom retaining portion 23, bottom retainable portion 24, top retaining portion 28, and top retainable portion 29 of each of the case members 20A and 20B having the same shape must only be able to be anchored to their counterparts of the opponent case member. It is to be understood, therefore, that these portions may be formed having various other shapes.

Figure 5:
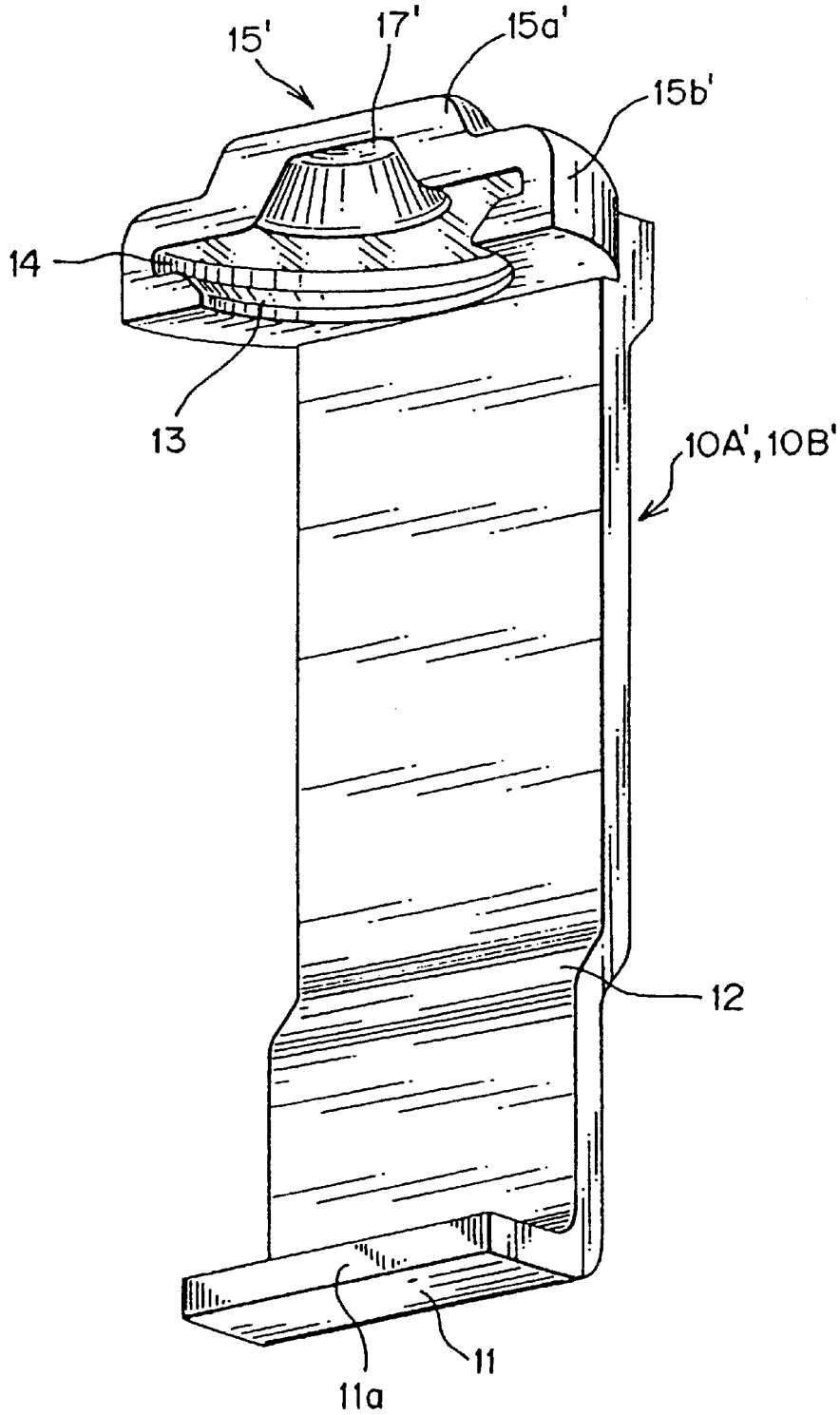
FIG. 5 is a perspective view of a sound insulating member that constitutes the expansion valve of the second embodiment.
Figure 6:
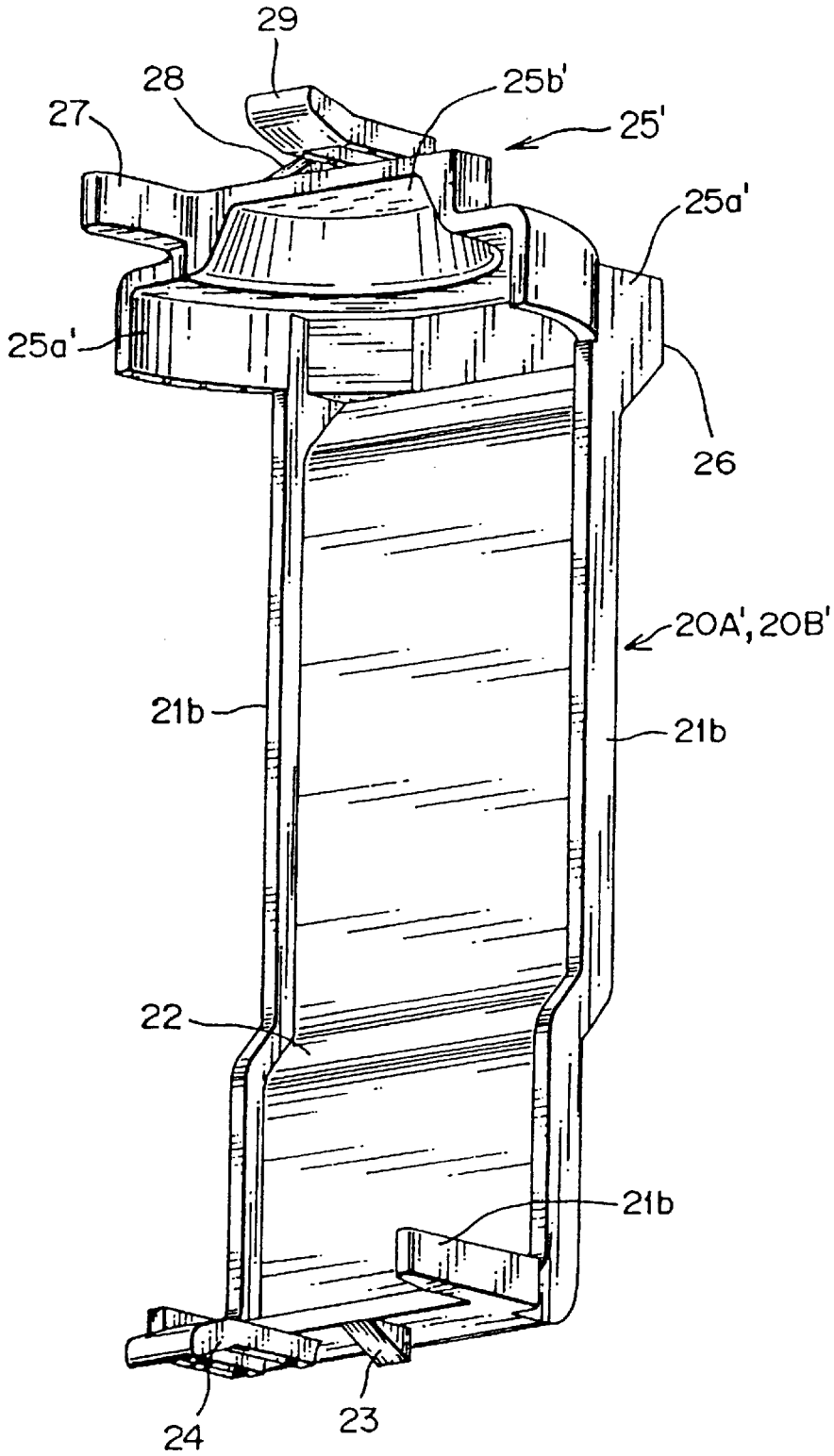
FIG. 6 is a perspective view of a case member that constitutes the expansion valve of the second embodiment.

A second embodiment will now be described with reference to FIGS. 4 to 6. In the description to follow, like numerals are used to designate like elements that are common to the first and second embodiments, and a detailed description of those elements is omitted. The following is a description of only those portions which differentiate the second embodiment from the first embodiment.

A top cover portion 15' of each of sound insulating members 10A' and 10B' has a semicircular shape as viewed from above. As shown in FIG. 5, cover extending portions 15*b*' are formed individually on the left- and right-hand sides of the cover portion 15'. A conical protrusion is formed on the upper surface of the top cover portion 15'. Further, a top recess 17' is formed in the lower surface of the top cover portion 15'. A top abutting surface 15*a*' is formed on the end face of the top cover portion 15'.

The sound insulating members 10A' and 10B' have the same shape. When they are opposed to each other and attached individually to the opposite side faces of the expansion valve body 5*a*, therefore, the respective top cover portion 15' (semicircular) of the members 10A' and 10B' are coupled to each other, thereby covering the top lid 9*f* of the expansion valve 5 throughout the circumference. This is a feature of the second embodiment.

A side cover portion 25*a*' is formed on each of the case members 20A' and 20B' so as entirely to cover the outside of the cover extending portion 15*b*' on its corresponding sound insulating member 10A' or 10B'. Further, a top space portion 25*b*' is formed under a top cover portion 25' of each case member 20A' or 20B'. The top protrusion of the top cover portion 15' of the sound insulating member 10A' can be fitted into the top space portion 25*b*'.

In other words, the side cover portion 25*a*' and the top space portion 25*b*' are designed after the respective external shapes of the cover extending portion 15*b*' and the top cover portion 15', respectively. For other particulars, the case members 20A' and 20B' are not different from the case members 20A and 20B of the first embodiment. A upper side face engaging portion 27 is formed on the upper part of each top cover portion 15' so as to press the shoulder portion of its corresponding top cover portion 25'.

Figure 4:
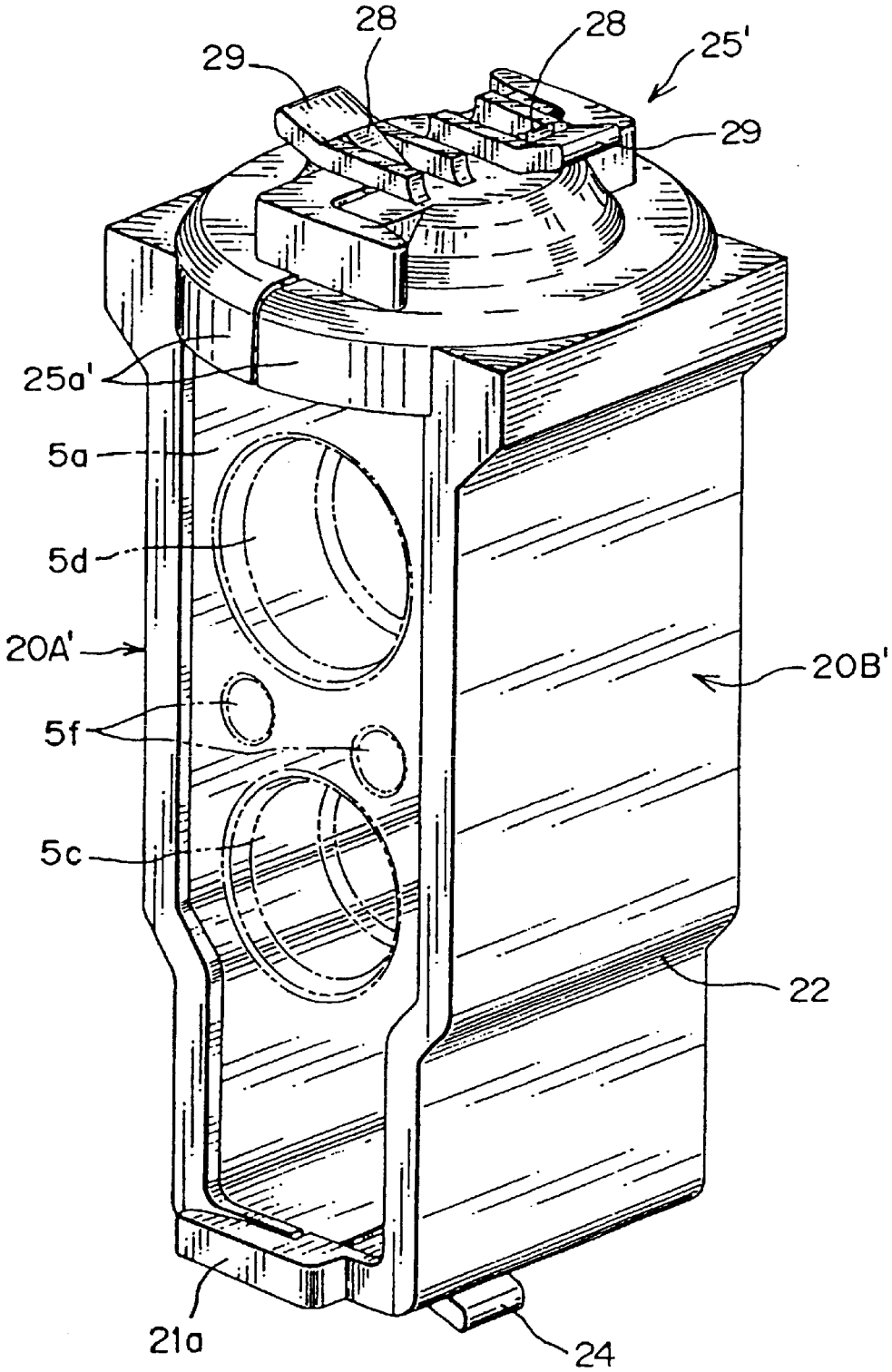
FIG. 4 is a perspective view showing an outline of an expansion valve according to a second embodiment of the invention.

The sound insulating members 10A' and 10B' and the case members 20A' and 20B' of the second embodiment may be attached to the opposite sides of the expansion valve body 5*a*, as shown in FIG. 4, by using the same means of the first embodiment. When the members 10A', 10B', 20A' and 20' are attached to the valve body 5*a*, the top lid 9*f* is covered entirely, so that sound insulating effect can be obtained as well as heat insulating effect.

Figure 7:
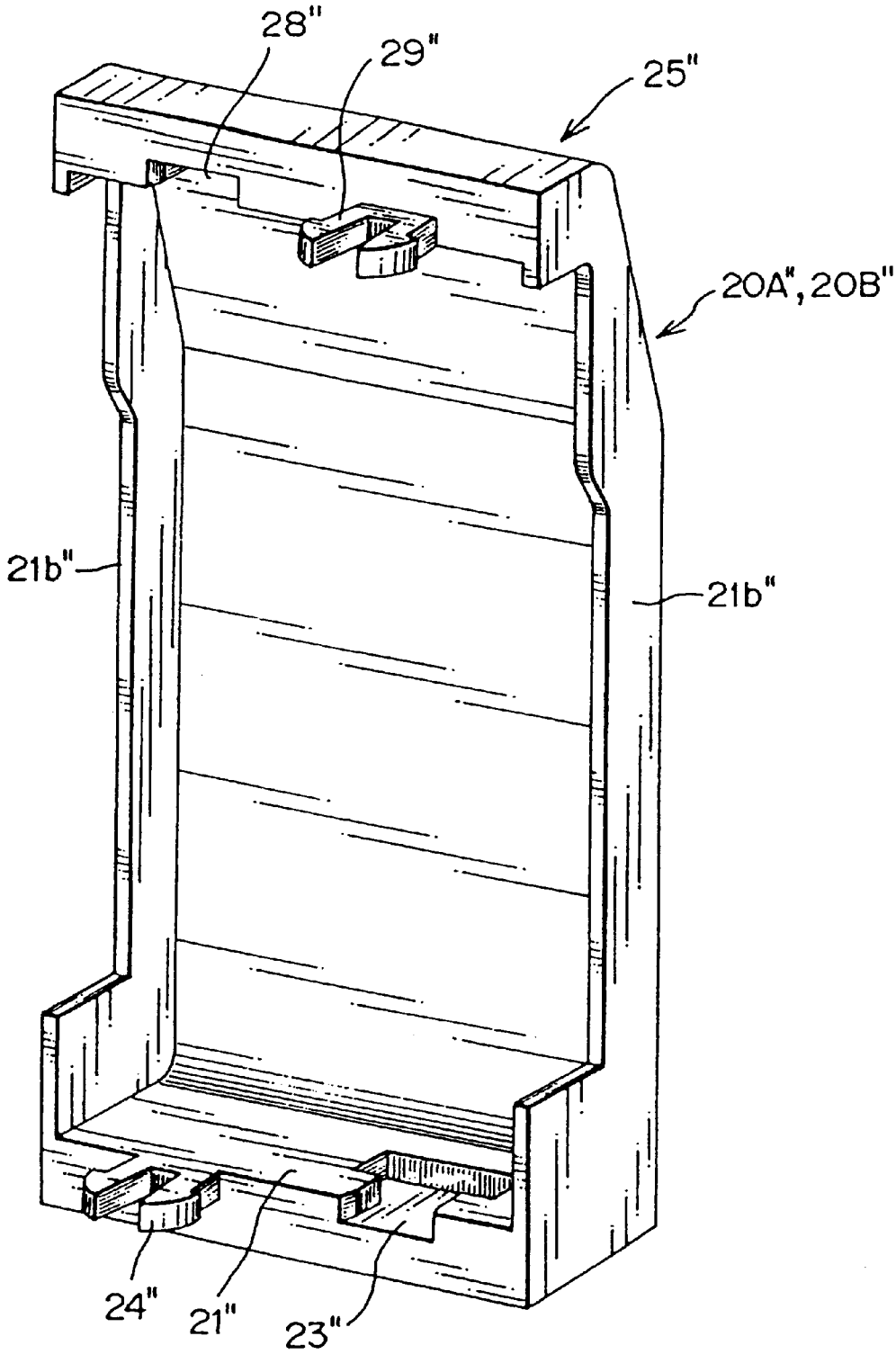
FIG. 7 is a perspective view of a case member that constitutes an expansion valve according to a third embodiment of the invention.
Figure 8:
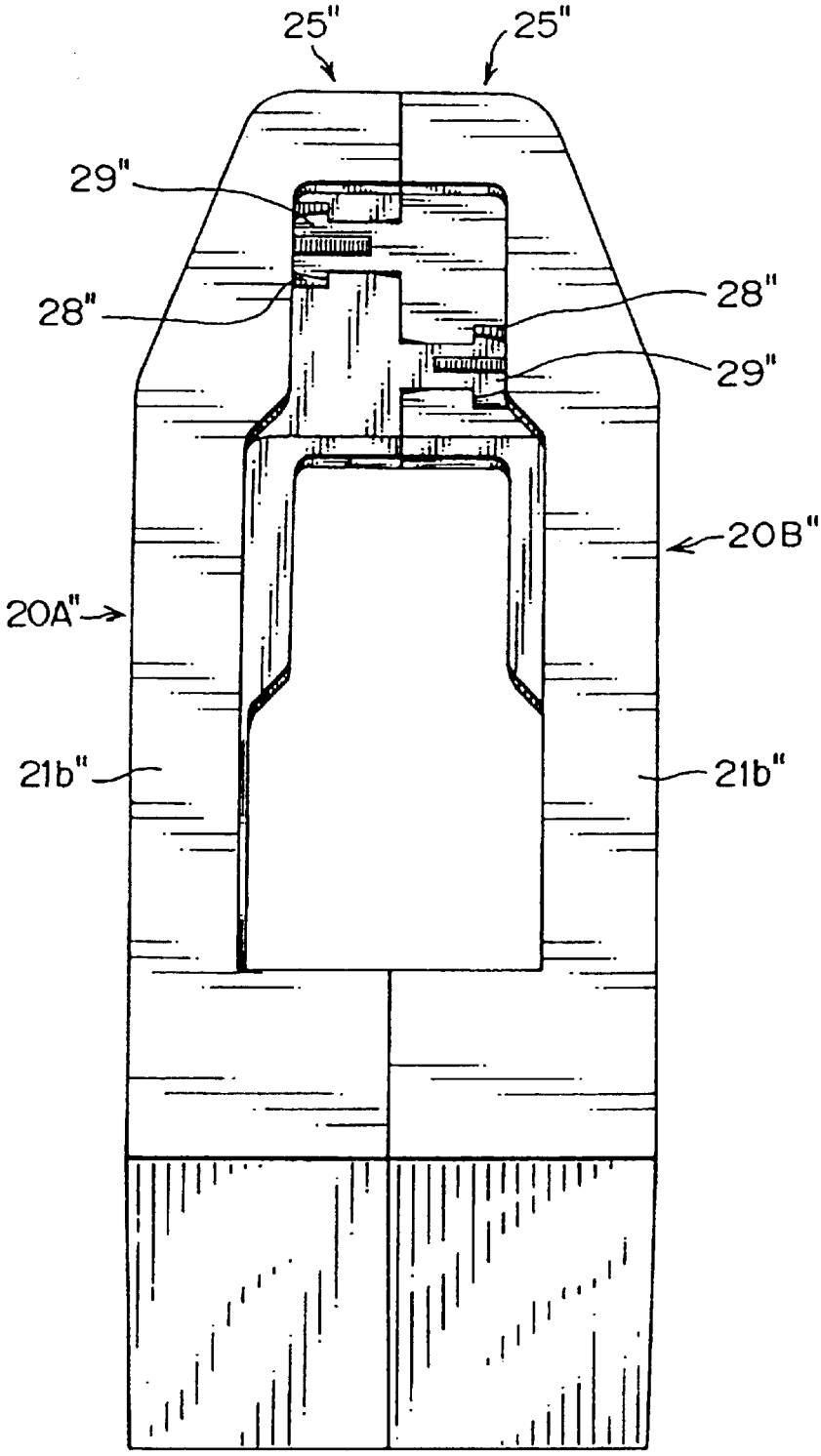
FIG. 8 is a view of two coupled case members of FIG. 7 taken diagonally from below.
Figure 9:
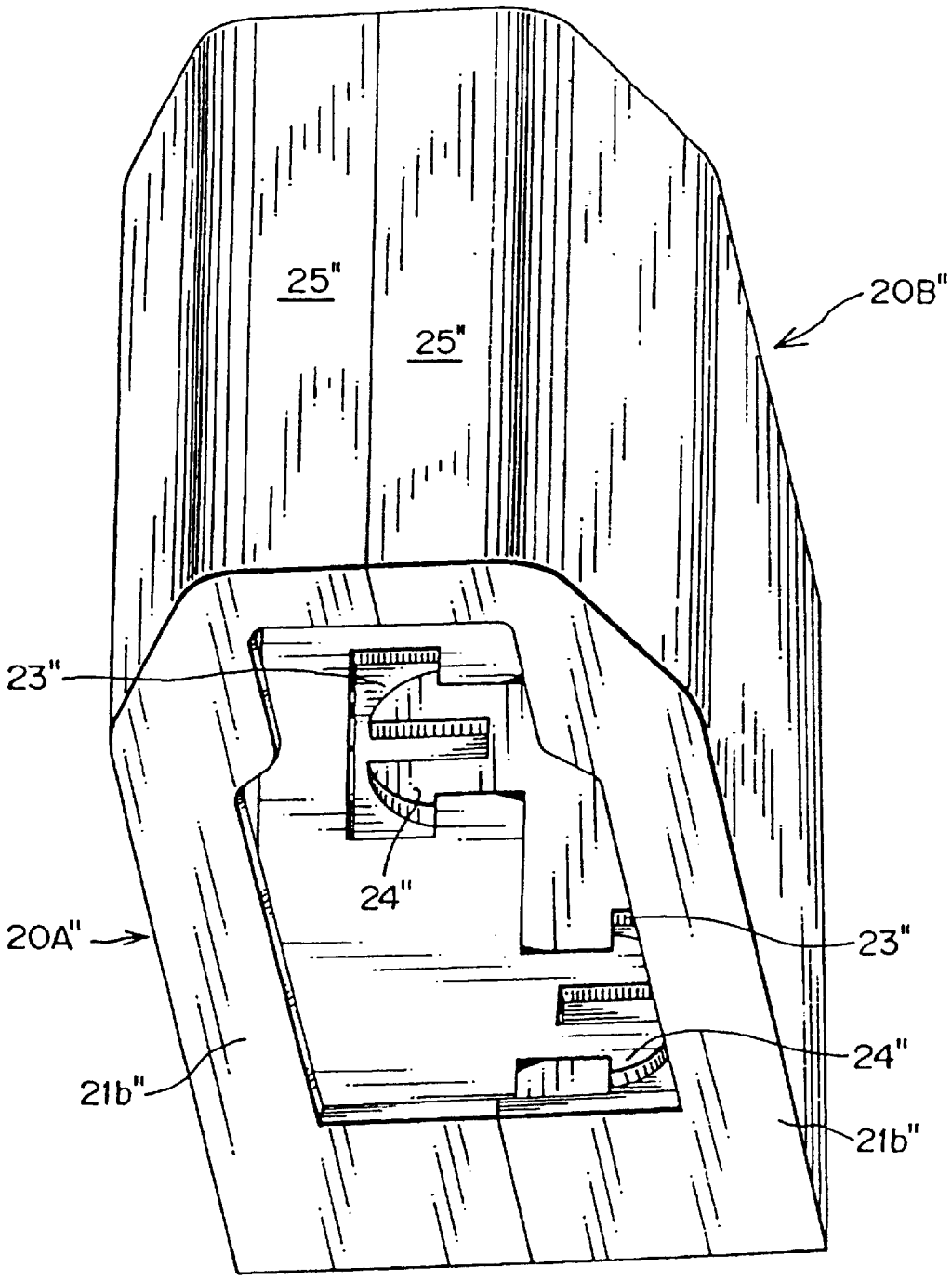
FIG. 9 is a view of the two coupled case members of FIG. 7 taken diagonally from above.

A third embodiment of the invention will now be described with reference to FIGS. 7 to 9. In the description to follow, like numerals are used to designate like elements that are common to the first and third embodiments, and a detailed description of those elements is omitted. The following is a description of only those portions which differentiate the third embodiment from the first embodiment.

This embodiment is characterized in the shape of case members 20A" and 20B". Each of sound insulating members (not shown) that are attached individually to the members 20A" and 20B" is in the form of a flat box. The inside of this box is shaped after the side face of the expansion valve body 5*a*, and its outside is smooth.

The case members 20A" and 20B" of the present embodiment have a bottom receiving portion 21" and a top cover portion 25" each. A bottom retaining portion 23" is formed on one side of the bottom receiving portion 21". It is a recess of which the inner part is widened. On the other hand, a club-shaped bottom retainable portion 24" projects forward from the other side of the bottom receiving portion 21" (i.e., in a position adjacent to the bottom retaining portion 23"). It can be elastically deformed so that its width is reduced.

A top retaining portion 28" having the same shape with the bottom retaining portion 23" is also formed on one side of the top cover portion 25" of each of the case members 20A" and 20B". A top retainable portion 29" having the same shape with the bottom retainable portion 24" is also formed on the other side of the top cover portion 25" so as to adjoin the top retaining portion 28".

Edge portions 21*b*" having a height substantially equal to the thickness of the sound insulating members are formed individually on the opposite side edge portions of each of the case members 20A" and 20B". When the case members 20A" and 20B" are attached to the expansion valve body 5*a* with the sound insulating members supported therein, they form a flat box having a simple external shape, as shown in FIGS. 8 and 9.

According to the third embodiment, the external and internal shapes of the case members 20A" and 20B" are simple. By selecting a suitable external shape for the sound insulating members, therefore, the case members 20A" and 20B" can be formed having various external shapes, e.g., shape of an ellipse or square.

The expansion valve that is covered by the case members 20A" and 20B" can be easily attached to a dashboard of the automobile in which a fitting hole is formed having a shape corresponding to that of a combination of the case members 20A" and 20B" coupled together (see FIGS. 8 and 9), for example.

In the third embodiment, as in the first embodiment, the bottom retaining portion 23", bottom retainable portion 24", top retaining portion 28", and top retainable portion 29" must only be able to engage one another. It is to be understood, therefore, that these portions may be formed having various other shapes.

Constructed in this manner, the expansion valve according to the present invention has the following effects.

Since the two case members of the same shape are attached to the expansion valve body with the sound insulating members between them, sound insulating and vibration-proof effects can be obtained, and besides, it is necessary only that components of the same shape be prepared as the case members. Thus, the manufacturing cost can be lowered, and handling the valve can be facilitated.

Since the two sound insulating members of the same shape are attached to the expansion valve body, sound insulating and vibration-proof effects can be obtained, and besides, the construction can be simplified, and handling can be made easier.

The retaining and retainable portions are formed side by side on the respective upper and lower parts of the case members. Thus, the two members of the same shape can be easily mounted or removed at a stroke in a manner such that the retaining and retainable portions are caused to engage one another when the members are attached to the expansion valve body.

Since the outer surface of each case member or sound insulating member is flat, handling properties, such as the ease of attachment of the expansion valve as a whole, are improved.

Since the two case members of the same shape are attached to the expansion valve body, sound insulating and vibration-proof effects can be obtained, and besides, it is necessary only that components of the same shape be prepared as the case members. Thus, the manufacturing cost can be lowered, handling the valve can be facilitated, and the construction can be simplified. Further, the retaining and retainable portions are formed side by side on the respective upper and lower parts of the case members. Thus, the two members of the same shape can be easily mounted or removed at a stroke in a manner such that the retaining and retainable portions are caused to engage one another when the members are attached to the expansion valve body.

Since the sound insulating case of the expansion valve is composed of the two sound insulating members of the same shape so that the two sound insulating cover members have a single configuration, the number of indispensable components can be reduced.

What is claimed is:

1. An expansion valve having an expansion body, comprising: two case members of identical shape and two sound insulating members of identical shape, wherein the two sound insulating members attach to the expansion body and the two case members attach to the two sound insulating members and each said case member or said sound insulating member has retaining portions and retainable portions arranged at the upper and lower parts thereof, the retaining portion of one case member or sound insulating member being capable of engaging the retainable portion of the other case member or sound insulating member, and the retainable portion of the one case member or sound insulating member being capable of engaging the retaining portion of the other case member or sound insulating member.

2. The expansion valve according to claim 1, wherein the outer surface of each said case member or sound insulating member is flat.

3. An expansion valve comprising an expansion valve body having therein a high-pressure-side passage, low-pressure-side passage, and orifice internally connecting the passages, a valving element opposed to the orifice, and a temperature sensing drive element having a diaphragm for driving the valving element by means of an operating rod and being located outside the expansion valve body, the expansion valve further comprising two case members of identical shape and two sound insulating members of identical shape, wherein the two sound insulating members attach to the expansion body and the two case members attach to the two sound insulating members.

4. The expansion valve according to claim 3, wherein said case member is attached to the entire temperature sensing drive element except a part thereof.

5. The expansion valve according to claim 3, wherein said case member is mounted through a sound insulating member.

6. The expansion valve according to claim 3, wherein one of said two members constituting the case member is formed having a retaining portion, and the other member is formed having a retainable portion in a position corresponding to the retaining portion, the case member being attached to the expansion valve body and the temperature sensing drive element with the retaining portion and the retainable portion in engagement with each other.

7. The expansion valve according to claim 6, wherein said retaining portion and said retainable portion are formed inside the case member.

8. The expansion valve according to claim 3, wherein each of said two members constituting the case member is formed having a retaining portion and a retainable portion, the case member being attached to the expansion valve body and the temperature sensing drive element in a manner such that the retaining portion of one of the members is in engagement with the retainable portion of the other member and that the retainable portion of the one member is in engagement with the retaining portion of the other member.

9. The expansion valve according to claim 8, wherein said retaining portion and said retainable portion are arranged side by side on each member.

10. A sound insulating case of an expansion valve having an expansion body, comprising two case members of identical shape and two sound insulating members of identical shape, wherein the two sound insulating members attach to the expansion body and the two case members attach to the two sound insulating members.

11. An insulator for a longitudinally-extending expansion valve having a first pair of sides disposed opposite one another with passages extending therethrough, a second pair of sides disposed opposite one another and connected to and extending between the first pair of sides to form a generally rectangular cross-sectional configuration, a top portion connected to respective ends of the first and second pair of sides and a bottom portion connected to opposing ends of the first and second pair of sides forming a generally box-shaped configuration, the insulation article comprising:

a pair of insulating members with each insulating member having a generally U-shaped configuration, a respective one of the insulating members covering one the second pair of sides, one-half of the top portion and one-half of the bottom portion such that the pair of insulating members contact each other at facially-opposing end surfaces at the top portion and the bottom portion to cover at least the second pair of sides, the top portion and the bottom portion in their entirety; and a pair of case members with each case member having a generally U-shaped configuration, a respective one of the case members covering one of the insulating members, the pair of case members operative to releasably engage each other adjacent the top and bottom portions of the expansion valve thereby encasing the pair of insulating members therein.

12. An insulator according to claim 11, wherein the pair of insulating members are fabricated from a sound insulating material.

13. An insulator according to claim 12, wherein the pair of insulating members are fabricated from resin or rubber.

14. An insulator according to claim 11, wherein the pair of insulating members are identical in shape.

15. An insulator according to claim 11, wherein each one of the case members includes at least one retaining portion and at least one retainable portion such that the at least one retaining portion on one case member releasably engages with the at least one retainable portion on the remaining case member so that the case members releasably engage with each other.

16. An insulator according to claim 15, wherein each one of the case members includes at least one side surface engaging portion projecting from a side surface of the case member and toward the other case member when the case members are to be releasably engaged with each other.

17. An insulator according to claim 16, wherein the pair of case members are identical in shape.

* * * * *